US007537550B1

(12) United States Patent
Krull

(10) Patent No.: US 7,537,550 B1
(45) Date of Patent: May 26, 2009

(54) EXERCISE WEIGHT STACK METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 304 days.

(21) Appl. No.: 11/300,261

(22) Filed: Dec. 13, 2005

Related U.S. Application Data

(60) Provisional application No. 60/635,884, filed on Dec. 14, 2004.

(51) Int. Cl.
*A63B 21/062* (2006.01)
*A63B 21/06* (2006.01)

(52) U.S. Cl. ..... 482/98; 482/94

(58) Field of Classification Search ..... 482/98–99, 482/92–94
See application file for complete search history.

(56) References Cited

U.S. PATENT DOCUMENTS

| | | | | | |
|---|---|---|---|---|---|
| 223,798 | A * | 1/1880 | Butler | 482/98 |
| 4,411,424 | A * | 10/1983 | Barnett | 482/99 |
| 4,509,745 | A * | 4/1985 | Angsten | 482/98 |
| 4,538,805 | A * | 9/1985 | Parviainen | 482/98 |
| 4,765,611 | A * | 8/1988 | MacMillan | 482/98 |
| 4,809,973 | A * | 3/1989 | Johns | 482/99 |
| 4,848,738 | A * | 7/1989 | Mueller | 482/98 |
| 4,974,837 | A * | 12/1990 | Someya et al. | 482/98 |
| 5,072,928 | A * | 12/1991 | Stearns et al. | 482/54 |
| 5,188,577 | A * | 2/1993 | Young et al. | 482/53 |
| 5,656,003 | A * | 8/1997 | Robinson et al. | 482/93 |
| 6,387,018 | B1 * | 5/2002 | Krull | 482/98 |
| 6,494,811 | B1 * | 12/2002 | Alessandri | 482/8 |
| 6,629,910 | B1 * | 10/2003 | Krull | 482/98 |
| 7,001,312 | B2 * | 2/2006 | Alessandri et al. | 482/54 |
| 2002/0128124 | A1 * | 9/2002 | Mosimann et al. | 482/92 |
| 2003/0060343 | A1 * | 3/2003 | Sechrest et al. | 482/94 |
| 2005/0101451 | A1 * | 5/2005 | Ooka | 482/99 |
| 2006/0030459 | A1 * | 2/2006 | Piane, Jr. | 482/99 |

* cited by examiner

*Primary Examiner*—Loan H Thanh
*Assistant Examiner*—Sandhara M Ganesan

(57) ABSTRACT

Weights are arranged in a vertical stack and movably mounted on a frame. On some embodiments, variable length members are provided to exert upward force against a weight supporting member associated with the stack when the weight supporting member is proximate its rest position relative to the frame. On other embodiments, the weights are rotated relative to the frame to selectively engage and disengage the weights for purposes of providing resistance to exercise motion.

12 Claims, 11 Drawing Sheets

Fig. 7
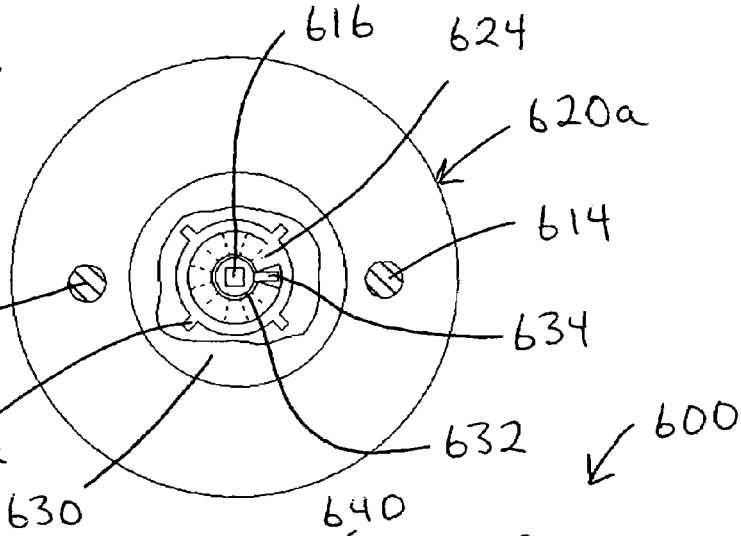
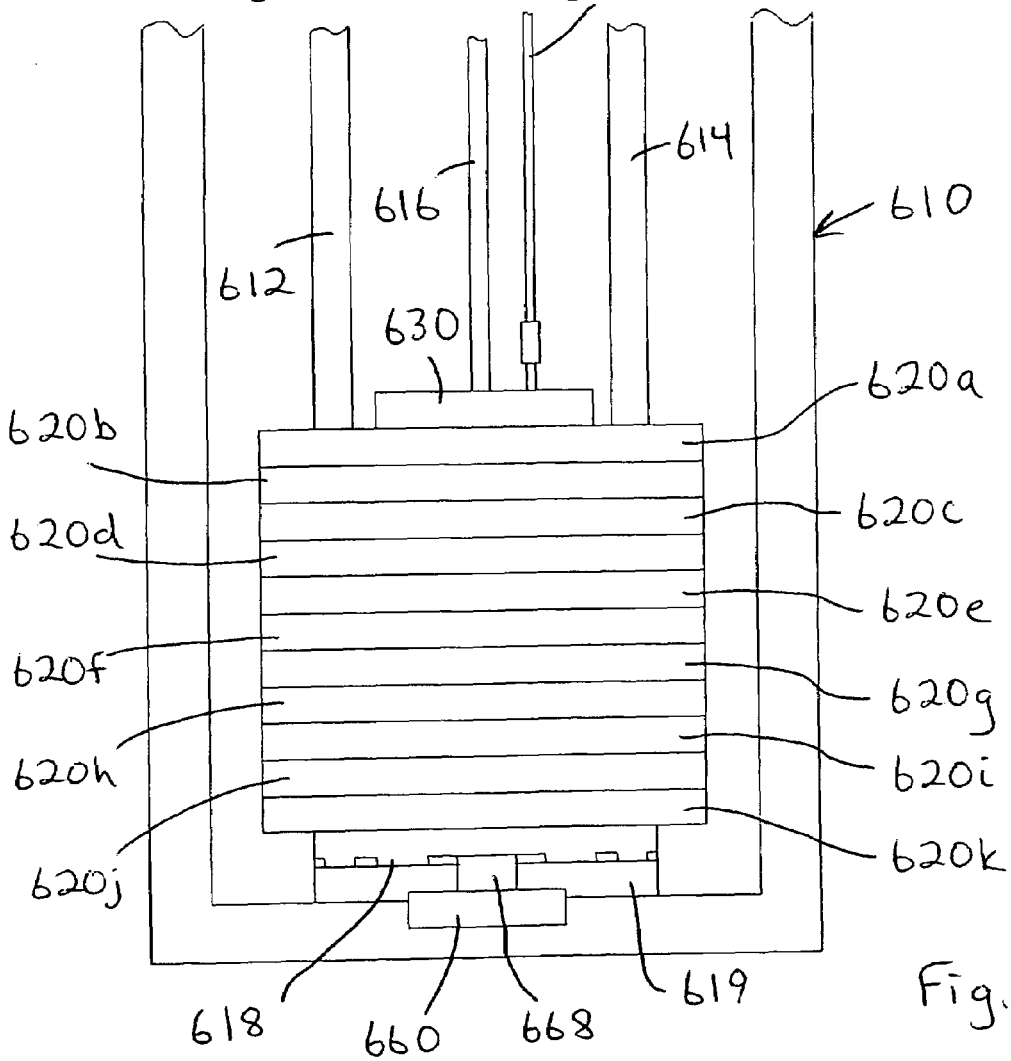
Fig. 6

Fig. 9
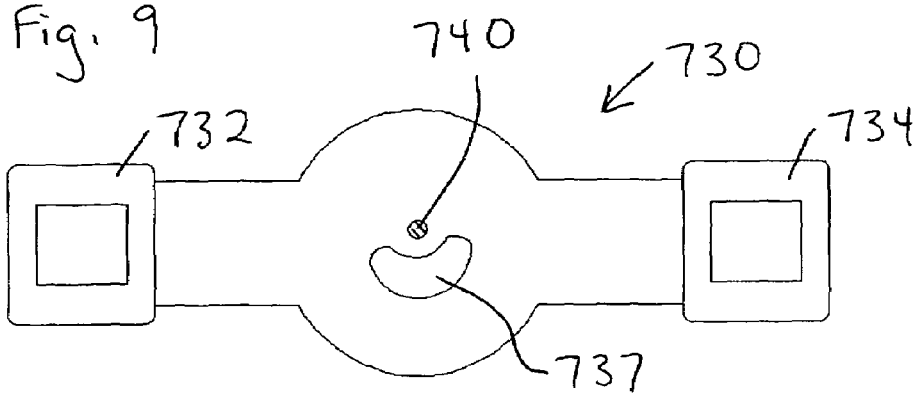
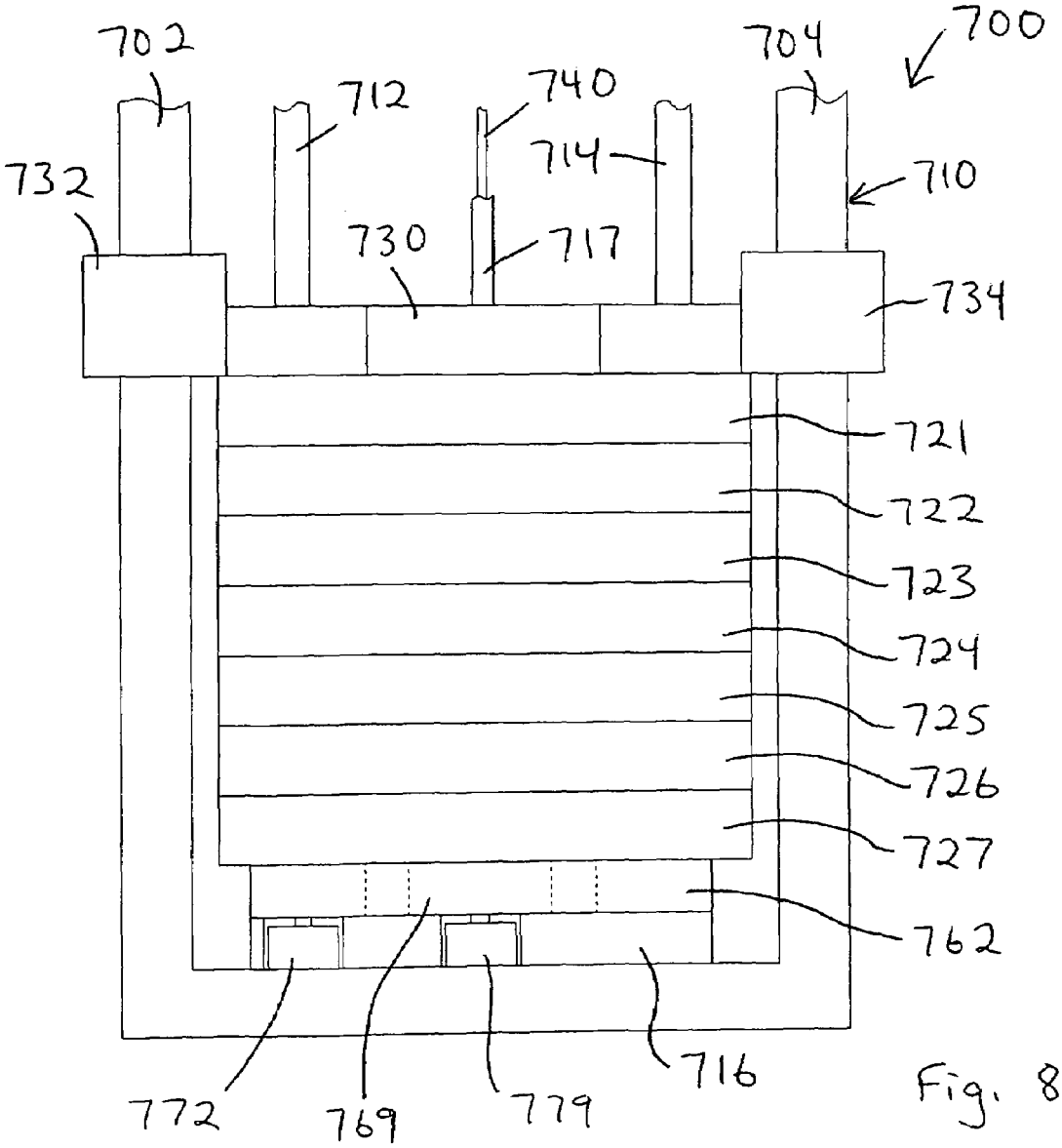
Fig. 8

Fig. 12
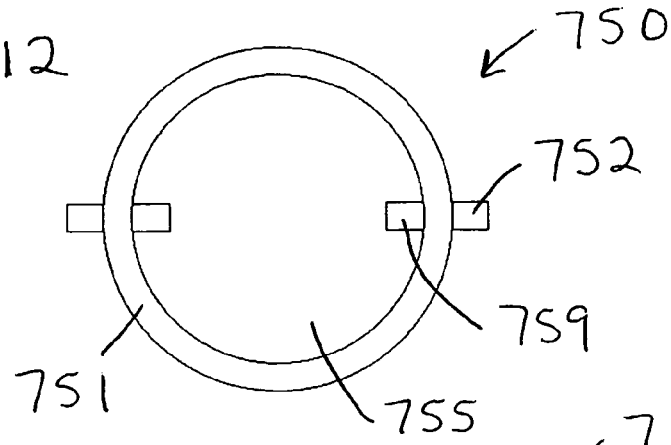
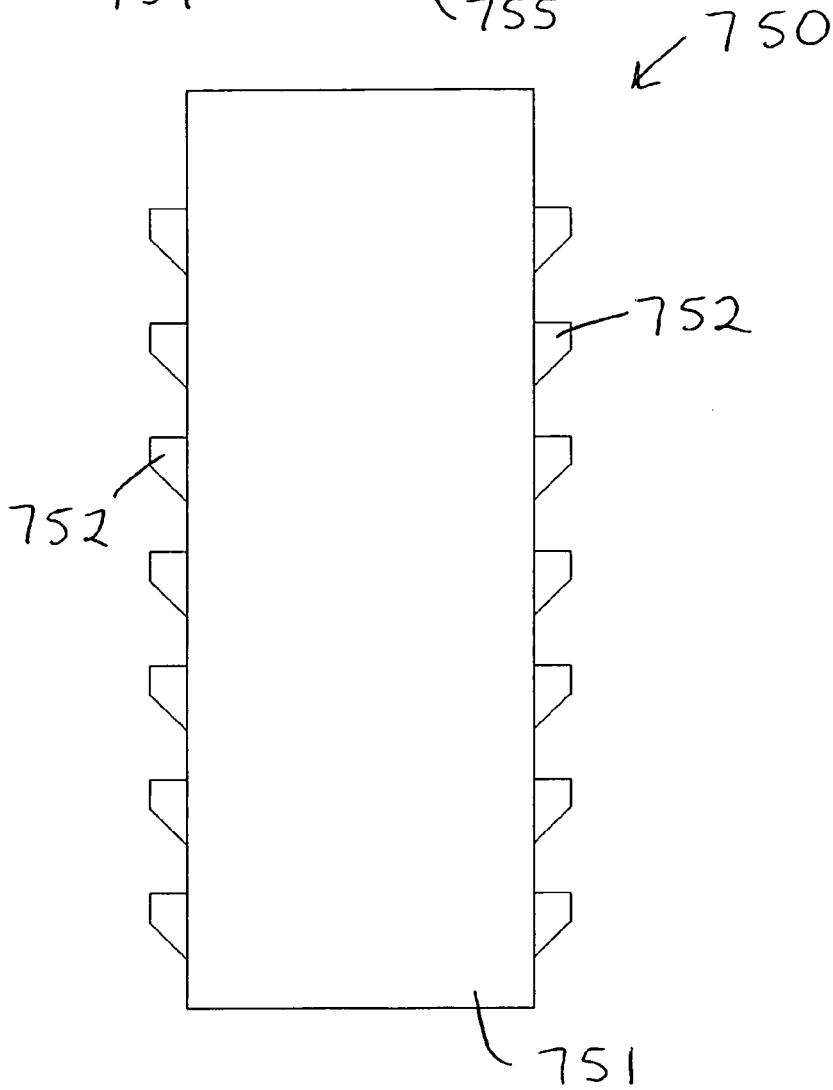
Fig. 11

EXERCISE WEIGHT STACK METHODS AND APPARATUS

CROSS-REFERENCE TO RELATED APPLICATION

Disclosed herein is subject matter that was previously disclosed in U.S. Provisional Application No. 60/635,884, filed on Dec. 14, 2004.

FIELD OF THE INVENTION

The present invention relates to exercise equipment and more particularly, to stacks of weights that may be engaged in different combinations to provide variable resistance to exercise motion.

BACKGROUND OF THE INVENTION

Exercise weight stacks are well known in the art and prevalent in the exercise equipment industry. Generally speaking, a plurality of weights or plates are arranged in a stack and maintained in alignment by guide members or rods. A desired amount of weight is engaged by selectively connecting a selector rod to the appropriate weight in the stack. The selector rod and/or the uppermost weight in the stack are/is connected to at least one force receiving member by means of a connector. The engaged weight is lifted up from the stack in response to movement of the force receiving member.

Some examples of weight stacks, their applications, and/or features are disclosed in U.S. Pat. No. 1,053,109 to Reach (shows a stack of weight plates, each having a slide which moves into and out of engagement with the weight plate or top plate above it); U.S. Pat. No. 3,912,261 to Lambert, Sr. (shows an exercise machine which provides weight stack resistance to a single exercise motion); U.S. Pat. No. 4,411,424 to Barnett (shows a dual-pronged pin which engages opposite sides of a selector rod); U.S. Pat. No. 4,546,971 to Raasoch (shows levers operable to remotely select a desired number of weights in a stack); U.S. Pat. No. 4,601,466 to Lais (shows bushings which are attached to weight stack plates to facilitate movement along conventional guide rods); U.S. Pat. No. 4,809,973 to Johns (shows telescoping safety shields which allow insertion of a selector pin but otherwise enclose the weight stack); U.S. Pat. No. 4,878,662 to Chern (shows a selector rod arrangement for clamping the selected weights together into a collective mass); U.S. Pat. No. 4,878,663 to Luquette (shows an exercise machine which has rigid linkage members interconnected between a weight stack and a force receiving member); U.S. Pat. No. 4,900,018 to Ish III, et al. (shows an exercise machine which provides weight stack resistance to a variety of exercise motions); U.S. Pat. No. 5,000,446 to Sarno (shows discrete selector pin configurations intended for use on discrete machines); U.S. Pat. No. 5,037,089 to Spagnuolo et al. (shows a controller operable to automatically adjust weight stack resistance); U.S. Pat. No. 5,263,915 to Habing (shows an exercise machine which uses a single weight stack to provide resistance to several different exercise motions); U.S. Pat. No. 5,306,221 to Itaru (shows a stack of weight plates, each having a lever which pivots into and out of engagement with a selector rod); U.S. Pat. No. 5,374,229 to Sencil (shows an alternative to conventional guide rods); and U.S. Pat. No. 6,186,927 to Krull (shows selector rods that rotate into engagement with weights within a stack), all of which are incorporated herein by reference. Despite these various advances in the exercise weight stack art, room for improvement and ongoing innovation remains.

SUMMARY OF THE INVENTION

The subject invention provides various ways to selectively engage vertically stacked weights for purposes of resisting exercise motion, as well as various ways to construct the associated exercise machines. On some embodiments, at least one spring/damper is provided to bias the top plate upward from its rest position and/or to resist movement of the top plate downward to its rest position relative to the frame. On other embodiments, the weights are rotatable into and out of engagement with at least one selector rod. Many of the features and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

FIG. 6 is a front view of another weight stack machine constructed according to the principles of the present invention;

FIG. 7 is a top view of a portion of the weight stack machine shown in FIG. 6;

FIG. 8 is a front view of another weight stack machine constructed according to the principles of the present invention;

FIG. 9 is a top view of a top plate on the weight stack machine shown in FIG. 8;

FIG. 11 is a front view of the weight selector shown in FIG. 10;

FIG. 12 is a top view of the weight selector shown in FIG. 10;

DETAILED DESCRIPTION OF A PREFERRED EMBODIMENT

Figure 1:
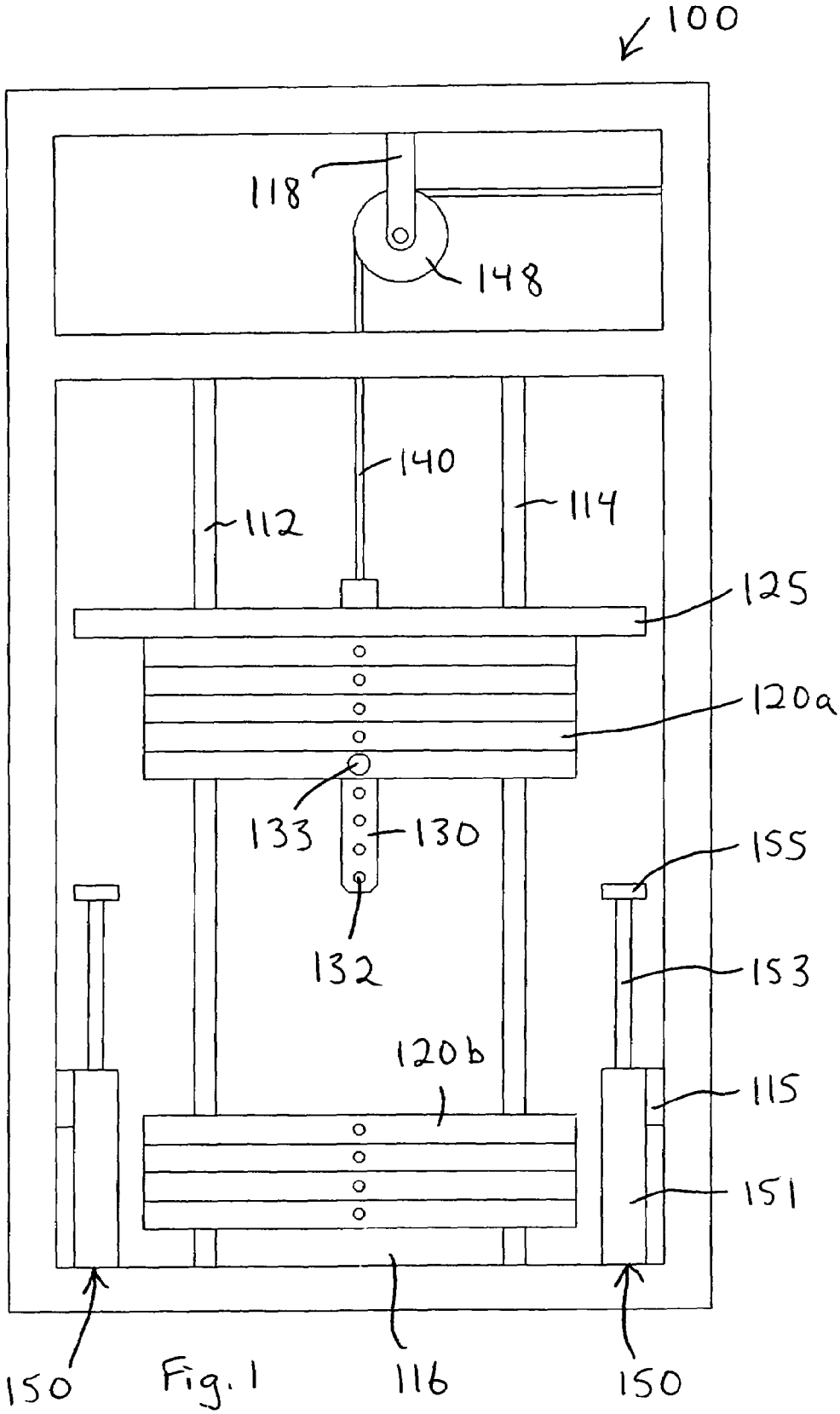
FIG. 1 is a front view of a weight stack machine constructed according to the principles of the present invention.

A first embodiment of the present invention is shown in FIG. 1, and may be described generally as a weight stack machine 100 having a frame 110 configured to rest on a floor surface, and a plurality of weights arranged into a vertical stack and movably mounted on the frame 110. First and second guide rods 112 and 114 are inserted through the weights and secured to the frame 110 to define a path of travel for the weights (perpendicular to the underlying floor surface). A weight support or base 116 is mounted on the frame 110 directly beneath the weight stack.

The weight stack includes a top plate or member 125 and a plurality of weights 120*a* and 120*b* disposed beneath the top plate 125. A weight selector 130 is connected to the top plate 125 and is operable in a manner known in the art to selectively engage the weights. For example, FIG. 1 shows a pin 133 inserted through both a hole in the lowermost one of the engaged weights 120*a* and an aligned one of the holes 132 in the weight selector 130. A cable or other flexible connector 140 is interconnected between a force receiving member (not shown) and the weight selector 130 and/or the top plate 125. An intermediate portion of the cable 140 is shown routed about a pulley 148 that is rotatably mounted on a frame member or trunnion 118.

Variable length members 150 are mounted on each side of the frame 110 via brackets 115 or other suitable means. Each member includes a cylinder 151 and a rod 153 that moves in telescoping fashion relative to the cylinder 151. An upper end 155 of each rod 153 is configured to engage a respective overlying portion of the top plate 125. Each member 150 is preferably a combination spring and damper that is biased toward the configuration shown in FIG. 1. An example of such a member is disclosed in U.S. Pat. No. 5,072,928 to Stearns, which is incorporated herein by reference.

The members 150 preferably exert upward bias force against the top plate 125 when it is at rest, and function to decelerate the top plate 125 and/or absorb energy from the descending weights 120*a* when they are moving toward a rest position on the frame 110. Among other things, the results may include less noise associated with the falling weights, less wear and tear on the machine 100 itself, and/or more fluid repetitions of a particular exercise. Those skilled in the art will also recognize that either the spring or the damper may be provided in the absence of the other on alternative embodiments.

Figure 2:
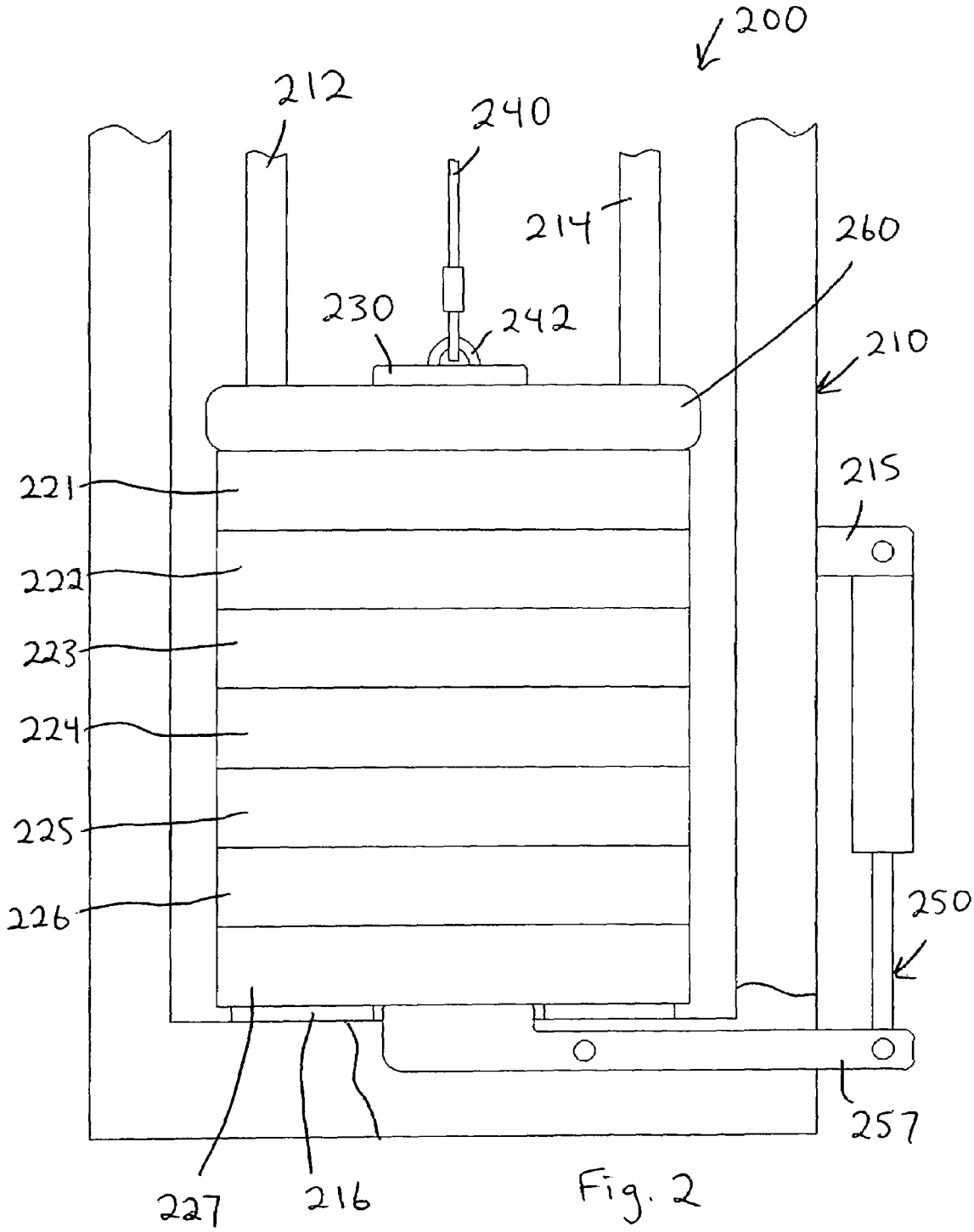
FIG. 2 is a front view of another weight stack machine constructed according to the principles of the present invention.

A second embodiment of the present invention is shown in FIG. 2, and may be described generally as a weight stack machine 200 having a frame 210 and a plurality of weights 260 and 221-227 arranged into a vertical stack and movably mounted on the frame 210. More specifically, first and second guide rods 212 and 214 are inserted through the stack and secured to the frame 210 to define a path of travel for the weight stack. Shock absorbing members or bumpers 216 are mounted on the frame 210 beneath the stack and in alignment with respective guide rods 212 and 214.

Like the first embodiment 100, the second embodiment 200 also has a flexible connector interconnected between the top plate 260 (via ring 242) and a user manipulated member (not shown), and a weight selector 230 connected to the top plate 260 and operable in a manner known in the art to selectively engage the weights 221-227. On this embodiment 200, the selector 230 operates in a manner disclosed in the Krull patent identified above and already incorporated herein by reference.

Figure 3:
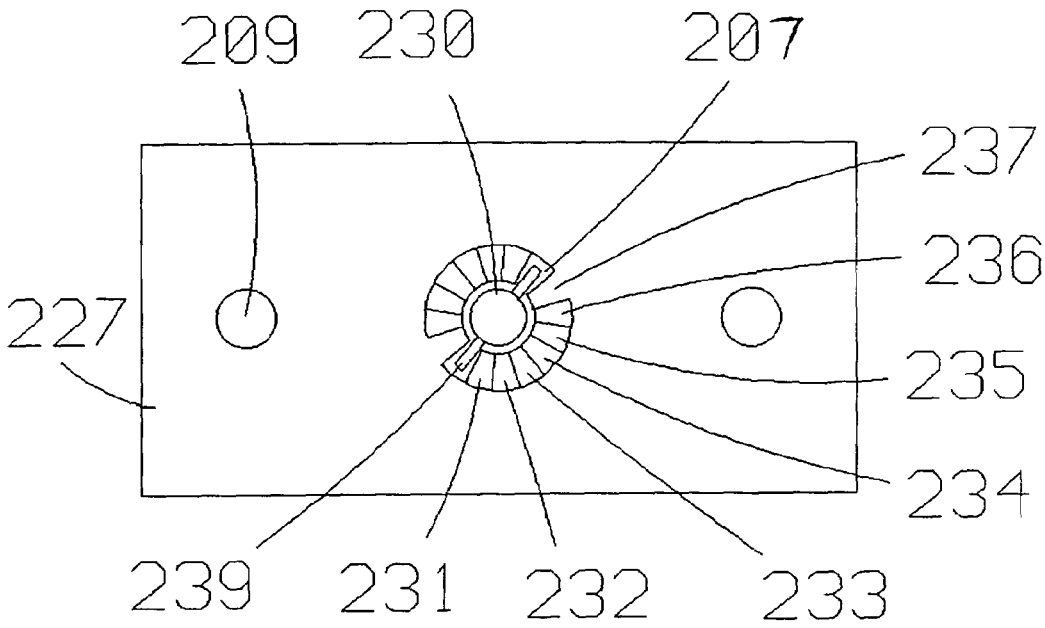
FIG. 3 is a top view of a weight stack on the machine shown in FIG. 2.

For ease of reference, FIG. 3 shows a top view of the stacked weights 221-227 (as viewed from below). Each weight plate has two diametrically opposed holes 209 to accommodate respective guide rods, and a central opening to accommodate the selector rod 230. Axially spaced, radially aligned pegs 239 project outward from diametrically opposed portions of the selector rod 230 and align with respective weights in the stack. The central opening in each weight plate includes diametrically opposed tabs (designated as 237 for the lowermost weight plate 227), and diametrically opposed notches (designated as 207 for the lowermost weight plate 227), which are disposed between the tabs. The relatively lower weight plates have relatively larger, diametrically opposed notches, which allow the successively higher and larger tabs (designated as 236, 235, 234, 233, 232, and 231, respectively) to be seen from below. The orientation of the selector rod 230 determines how many weights are engaged for resistance to exercise motion. In FIG. 1, none of the weights is selected, and the selector rod 230 is rotated counter-clockwise in increments of twenty-two degrees to successively engage the weights (beginning with the uppermost weight).

FIG. 2 also shows a variable length member 250 similar to the member 150 described above with reference to the first embodiment 100. The member 250 has an upper, cylinder end that is pivotally connected to frame bracket 215, and a lower, rod end that is pivotally connected to a first end of a lever 257. An opposite, second end of the lever 257 underlies the weight selector 230, and is configured to engage the lower end of the weight selector 230 as the top plate 260 approaches a rest position relative to the frame 210. An intermediate portion of the lever 257 is pivotally connected to the frame 210. For purposes similar to those discussed above with reference to the first embodiment 100, the member 250 is designed to push the proximate end of the lever 257 downward and to resist upward movement of same.

Figure 4:
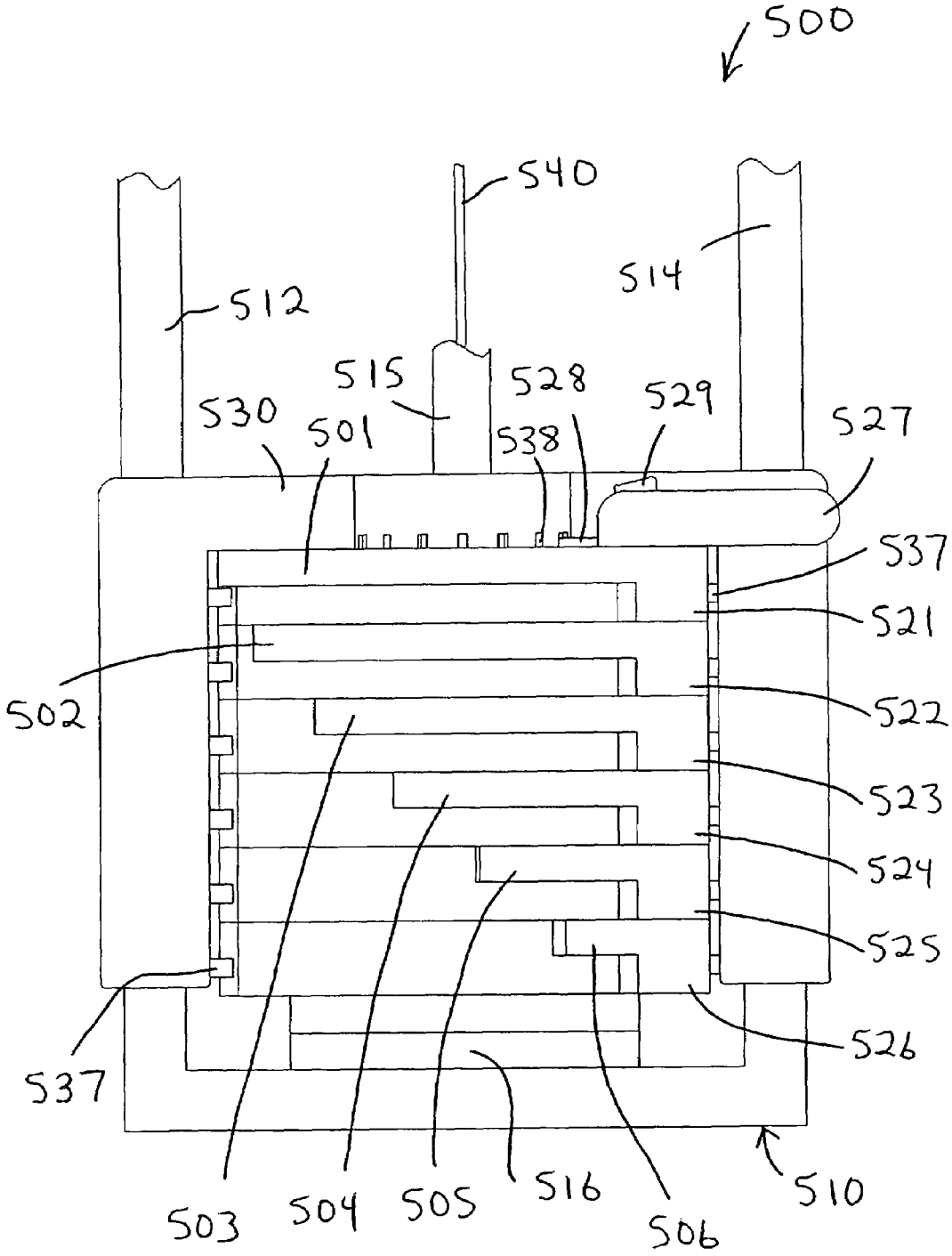
FIG. 4 is a front view of another weight stack machine constructed according to the principles of the present invention.

A third embodiment of the present invention is shown in FIG. 4, and may be described generally as a weight stack machine 500 having a frame 510 and a plurality of weights 521-526 arranged into a vertical stack and movably mounted on the frame 510. A single guide rod 515 is inserted through a central hole in each of the weights 521-526, and is rotatably mounted on the frame 510 to define a path of travel for the weights 521-526. A turntable 516 is mounted on the frame 510 directly beneath the lowermost weight 526, and a lower distal end of the guide rod 515 is rigidly secured to an upper section of the turntable 516 (which rotates relative to the lower section). An opposite, upper distal end of the guide rod 515 is rotatably connected to the frame 510 by a bushing, bearings, or other suitable means. The central hole in each weight 521-526 is square in shape and only slightly larger than the square cross-section of the guide rod 515, thereby preventing relative rotation between the weights 521-526 and the guide rod 515.

A top plate 530 is movably mounted on opposite side frame members 512 and 514 (via openings 531 and 534), and a central hole 531 through the top plate 530 accommodates both passage of the guide rod 515 through the top plate 530 and rotation of the guide rod 515 relative to the top plate 530. The top plate 530 is shown as a single, inverted U-shaped part, but is preferably manufactured as a combination of several discrete parts. Vertically aligned tabs or pegs 537 projected inward from opposite leg portions of the top plate 530 to selectively engage respective weights 521-526 in the stack, as further described below. As on other embodiments, a cable or other flexible connector 540 is interconnected between the top plate 530 and a force receiving member (not shown).

Figure 5:
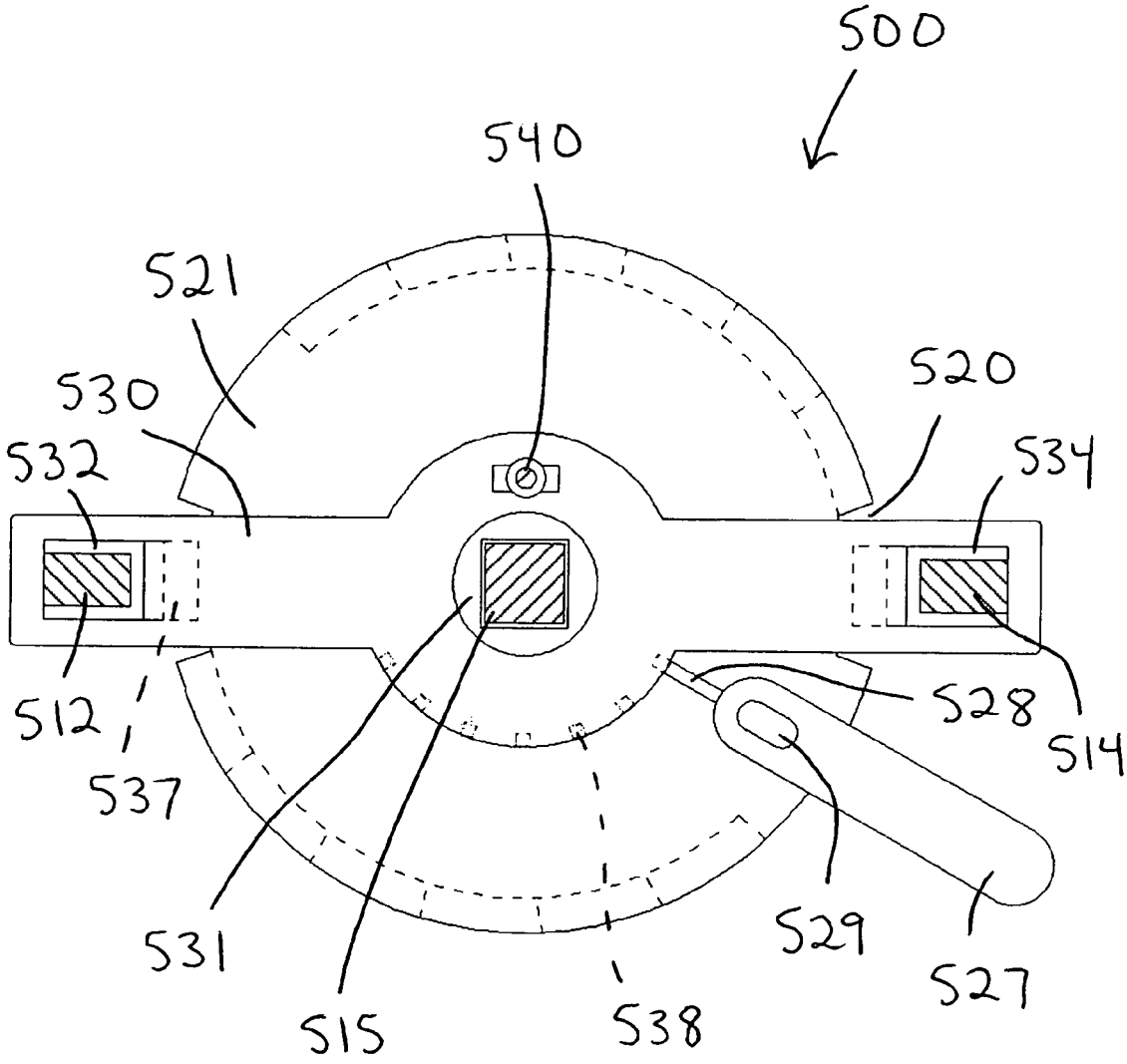
FIG. 5 is a top view of a portion of the weight stack machine shown in FIG. 4.

Each weight 521-526 is a generally disc-shaped member having respective, diametrically opposed notches extending inward from its periphery. One of the notches in the uppermost plate 521 is designated as 520 in FIG. 5, and the notches in the relatively lower plates 522-526 become larger as a function of distance from the uppermost plate 521. When the notches 520 are aligned with the pegs 537 (as shown in FIGS. 4-5), the top plate 530 is movable upward relative to the frame 510 without any of the weights 521-526 engaged and moving therewith.

Each weight 521-526 also has respective, diametrically opposed lips or flanges 501-506 having arc lengths that become shorter as a function of distance from the uppermost plate 521. When the peripheral lips are rotated (clockwise in FIG. 5) into vertical alignment with the pegs 537, the top plate 530 is movably upward relative to the frame 510 with the associated weights engaged and moving therewith. The weights 521-526 are rotated clockwise in twenty degree increments in FIG. 5 to successively engage the next lowest weight.

A radially protruding handle 527 is rigidly mounted on the uppermost weight 521 to facilitate rotation of the stack relative to the frame 510. A spring-biased plunger or pin 528 is movably connected to the handle 527, and rigidly connected to a button 529 on the handle 527. A spring (not shown) biases the plunger 528 and the button 529 toward the top plate 530 in a manner known in the art. The handle 527 and the button 529 are preferably configured and arranged in such a manner that a person may comfortably grab the handle 527 in his hand and use his thumb to move the button 529 away from the top plate 530. Circumferentially spaced recesses 538 are provided in the top plate 530 to accommodate a leading end of the plunger 528 at twenty degree intervals (which correspond to desired orientations of the weights 521-526 relative to the pegs 537). In other words, the plunger 528 encourages the stack of weights 521-526 to lock into a desired orientation, and discourages undesired rotation of the stack of weights 521-526 during exercise activity.

A fourth embodiment of the present invention is shown in FIG. 6, and may be described generally as a weight stack machine 600 having a frame 610 and a plurality of weights 620*a*-620*k* arranged into a vertical stack and movably mounted on the frame 610. First and second guide rods 612 and 614 are inserted through the weights 620*a*-620*k*, and are rotatably mounted on the frame 610 to define a path of travel for the weights 620*a*-620*k*. A first turntable 619 is mounted on the frame 610 directly beneath the lowermost weight 620*k*, and a lower distal end of each guide rod 612 and 614 is rigidly secured to an upper section of the turntable 619 (which rotates relative to the lower section). An opposite, upper distal end of each guide rod 612 and 614 is similarly connected to an upper, second turntable proximate the top of the frame 610.

A top plate 630 is movably mounted on a central guide rod 616 having a square cross-section that prevents rotation of the top plate 630 relative thereto. A weight selector 632 is rigidly connected to the top plate 630, and is similarly movably mounted on the guide rod 616. Vertically aligned tabs or pegs 634 project radially outward from axially spaced positions along the weight selector 631. On this particular embodiment 600, the pegs 634 are arranged to extend toward the guide rod 614. As on other embodiments, a cable or other flexible connector 640 is interconnected between the top plate 630 and a force receiving member (not shown).

Each weight 620*a*-620*k* is a disc-shaped member having a central opening sized and configured to receive a respective insert that is unique to a particular weight. The insert for the uppermost weight 620*a* is designated as 622 in FIG. 7, and the associated flange or lip is designated as 624. The lip 624 defines a relatively small notch that is aligned with the tabs 634 in FIG. 7. As suggested by the dashed lines in FIG. 7, the lips on the other inserts define increasingly larger notches as one progresses down the stack of weights 620*a*-620*k*, and the size of the lip associated with the lowermost weight 620*k* is slightly smaller than the size of the notch defined by the insert 622.

When the weights 620*a*-620*k* are oriented as shown in FIG. 7 (with all of the notches aligned with the pegs 634), the top plate 630 and the selector rod 632 are movable upward relative to the frame 610 without any of the weights 620*a*-620*k* engaged thereby or moving therewith. Recognizing that there are eleven weights 620*a*-620*k* and one open orientation, twelve discrete sectors are required to successively rotate each weight 620*a*-620*k* into engagement with the weight selector 632, and thus, thirty degrees may be allocated to each sector. When the weights 620*a*-620*k* are rotated thirty degrees in a first direction (from the orientation shown in FIG. 7), the lip 624 associated with the uppermost weight 620*a* is aligned with the uppermost peg 634 on the selector 632, and the top plate 630 is movable upward relative to the frame 610 together with the weight 620*a*. On the other hand, when the weights 620*a*-620*k* are rotated thirty degrees in an opposite, second direction (from the orientation shown in FIG. 7), the lips associated with all of the weights 620*a*-620*k* are aligned with respective pegs 634 on the selector 632, and the top plate 630 is movable upward relative to the frame 610 together with all of the weights 620*a*-620*k*.

Rotation of the weights 620*a*-620*k* may be accomplished by maneuvering one or both guide rods 612 and 614 in desired fashion. Circumferentially spaced notches 618 are provided in the upper section of the turntable 619 to accommodate a latching member 660 at thirty degree intervals (which correspond to desired orientations of the weights 620*a*-620*k* relative to the pegs 634). The latching member 660 may be described in terms of a spring-biased member 668 that is anchored in a fixed position relative to the frame 610, and biased upward toward the upper section of the turntable 619. Also, a pedal portion of the latching member 660 is connected to the spring-biased member 668, and is accessible and configured for depression by a person's foot. The spring-biased member 668 encourages the stack of weights 620*a*-620*k* to lock into any desired orientation, and discourages undesired rotation of the stack of weights 620*a*-620*k* during exercise activity. Upwardly facing indicia are preferably provided on the upper section of the turntable 619 to show a user how to orient the stack of weights 620*a*-620*k* to engage a desired amount of weight.

Figure 10:
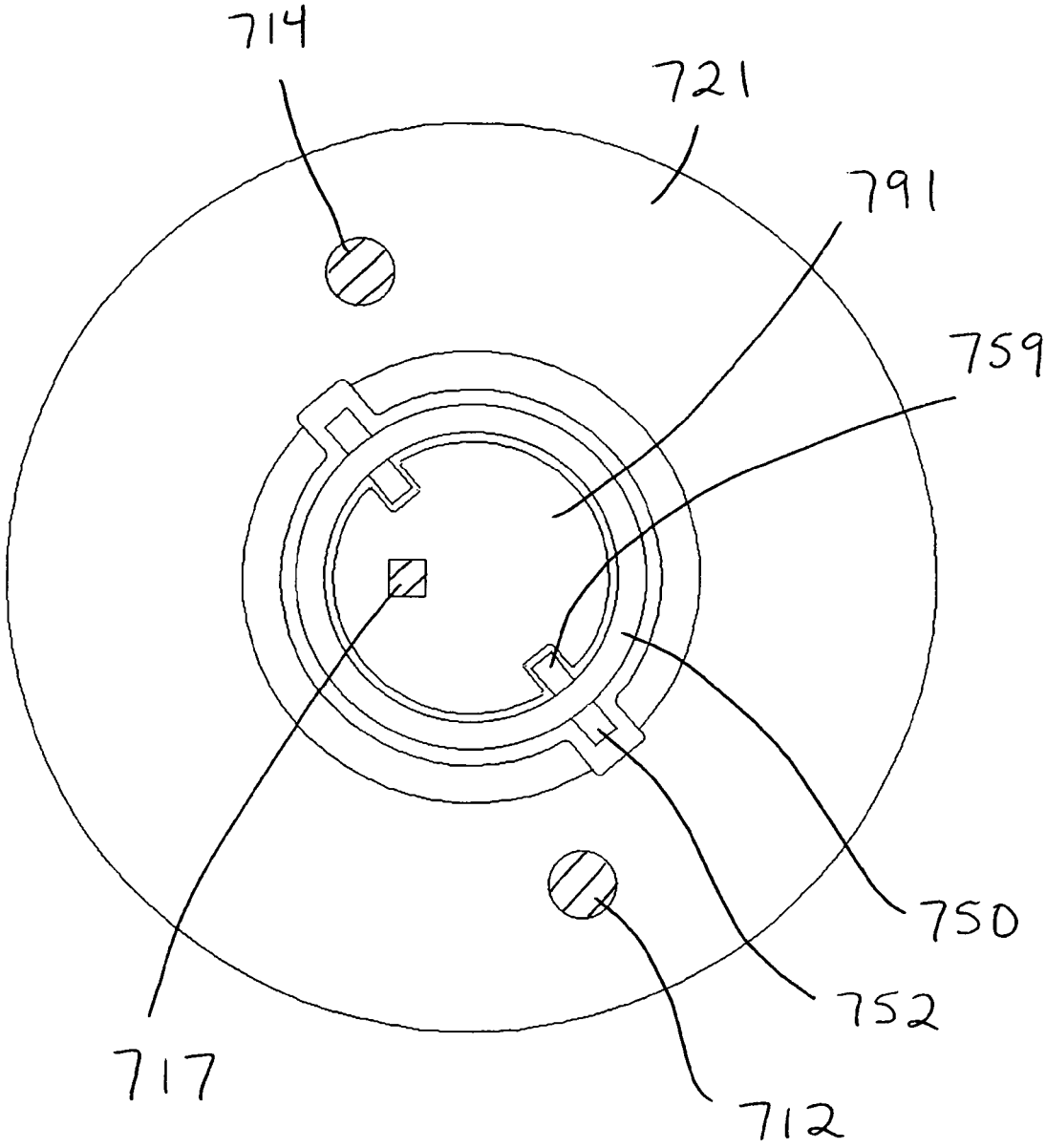
FIG. 10 is a top view of a portion of the weight stack machine shown in FIG. 8, showing two stacks of concentrically nested weights with a weight selector concentrically nested therebetween.

A fifth embodiment of the present invention is shown in FIG. 8, and may be described generally as a weight stack machine 700 having a frame 710 and two concentrically nested, vertical stacks of weights movably mounted on the frame 710. FIG. 10 shows the second stack of weights 791-795 nested inside a weight selector 750, which in turn, is nested inside the first stack of weights 721-727. First and second guide rods 712 and 714 are inserted through the first stack of weights 721-727, and are rotatably mounted on the frame 710 to define a path of travel for the weights 721-727. A third guide rod 717 is inserted through the second stack of weights 791-795, and is also rotatably mounted on the frame 710 to define a path of travel for the weights 791-795. The third guide rod 717 has a square cross-section that prevents rotation of the weights 791-795 relative thereto.

A first, lower turntable 716 is mounted on the frame 710 directly beneath the lowermost weights 727 and 795. A lower distal end of each guide rod 712 and 714 is rigidly secured to an upper outer section 762 of the turntable 716 (which rotates relative to the lower section). A lower distal end of the third guide rod 717 is rigidly secured to an upper inner section 769 of the turntable 716 (which rotates relative to both the lower section and the upper outer section 762). As suggested by the dashed lines in FIG. 8, the upper inner section 769 of the turntable 716 is concentrically nested within the upper outer section 762. An opposite, upper distal end of each guide rod 712, 714, and 717 is similarly connected to a respective section of a second, upper turntable proximate the top of the frame 710.

Figures 13, 14, 15, 16:
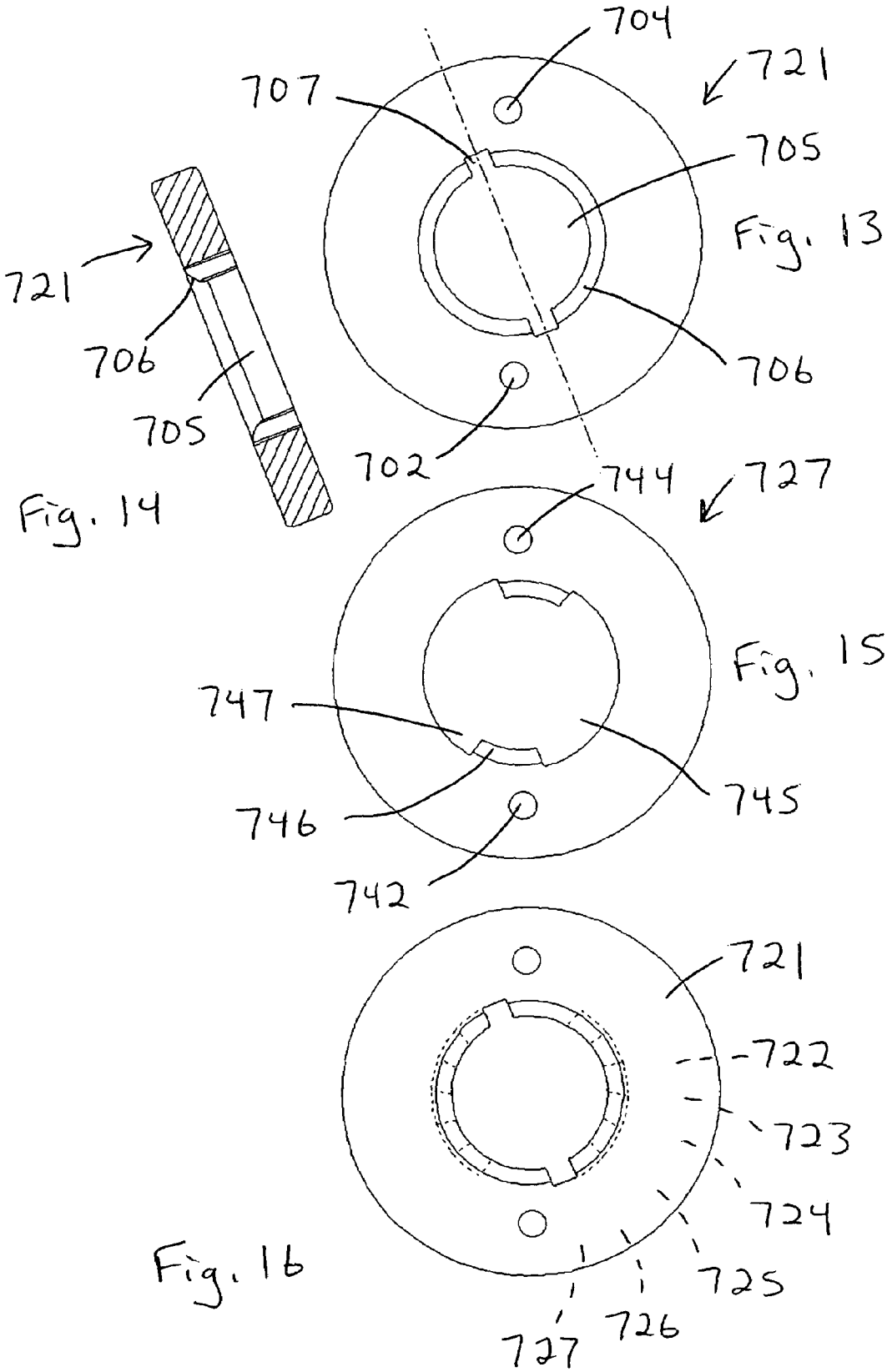
FIG. 13 is a top view of an uppermost weight in the stack of larger weights shown in FIG. 10.
FIG. 14 is a sectioned side view of the weight shown in FIG. 13.
FIG. 15 is a top view of a lowermost weight in the stack of larger weights shown in FIG. 10.
FIG. 16 is a top view of the stack of larger weights shown in FIG. 10, with notches in hidden weights shown in dashed lines.

FIGS. 13-16 show the weights 721-727 in the first stack apart from the rest of the machine 700. As shown in FIG. 13, the uppermost large weight 721 has an annular shape that defines a central opening 705 to accommodate insertion of the selector 750 (when properly oriented). As shown in FIG. 14, a beveled or rounded lead-in surface 706 is provided between the opening 705 and the upper face of the weight 721. Holes 702 and 704 extend through the weight 721 to accommodate respective guide rods 712 and 714 (and preferably bushings disposed inside the holes 702 and 704 and about the guide rods 712 and 714). The weight 721 also has diametrically opposed notches 707 that are defined between diametrically opposed lips or flanges (which are bounded by the lead-in surface 706).

As shown in FIG. 15, the lowermost large weight 727 is similar in size and shape to the uppermost weight 721, except for the size of its notches 747 (and the lips disposed therebetween). In this regard, the notches increase in size from top to bottom in the stack of weights 721-727. FIG. 16 shows the first stack of weights 721-727, and the dashed lines show the respective flanges relative to one another.

As is the case with all of the other weights 721-726, holes 742 and 744 extend through the weight 727 to accommodate respective guide rods 712 and 714 (and preferably bushings disposed inside the holes 702 and 704 and about the guide rods 712 and 714). Also, the weight 727 defines a central opening 745 to accommodate insertion of the selector 750 (when properly oriented), as well as a beveled and/or rounded lead-in surface 746 provided between the opening 745 and the upper face of the weight 727. The lead-in surfaces on the weights 721-727 help guide the weight selector 750 downward through any disengaged weights and also provide space for structurally enhanced tabs 752 on the weight selector 750.

Figure 17:
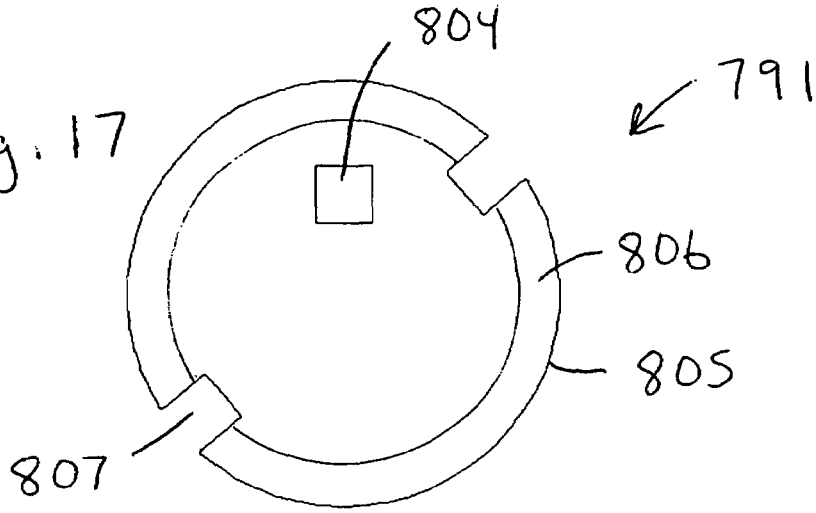
FIG. 17 is a top view of an uppermost weight in the stack of smaller weights shown in FIG. 10.
Figure 18:
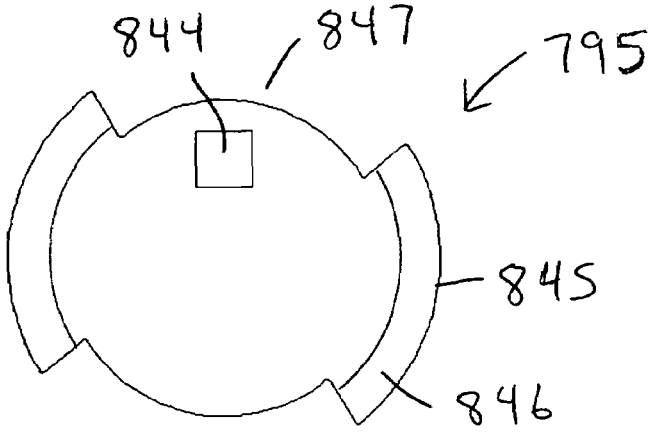
FIG. 18 is a top view of a lowermost weight in the stack of smaller weights shown in FIG. 10.
Figure 19:
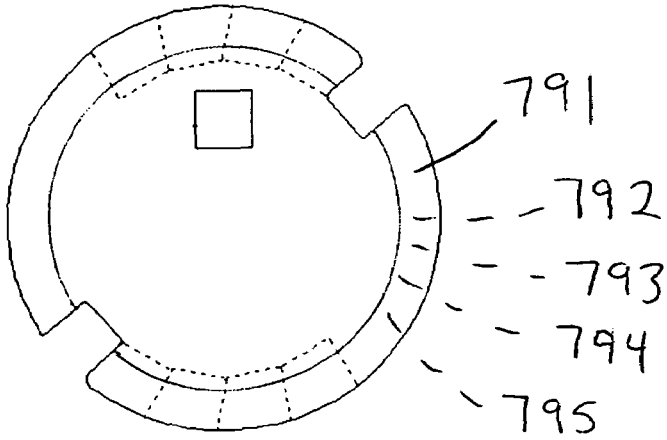
FIG. 19 is a top view of the stack of smaller weights shown in FIG. 10, with notches in hidden weights shown in dashed lines.

FIGS. 17-19 show the weights 791-795 in the second stack apart from the rest of the machine 700. The uppermost small weight 791 has a cylindrical shape that is bounded by a sidewall 805, and that is configured for insertion into the selector 750 (when properly oriented). A beveled or rounded lead-in surface 806 is provided between the upper end of the sidewall 805 and the upper face of the weight 791. A square hole 804 extends through the weight 791 to accommodate the guide rod 717 (and preferably a bushing disposed inside the hole 804 and about the guide rod 717). The weight 791 also has diametrically opposed notches 807 that are defined between diametrically opposed lips or flanges (which are bounded by the lead-in surface 806).

As shown in FIG. 18, the lowermost small weight 795 is similar in size and shape to the uppermost weight 791, except for the size of its notches 847 (and the lips disposed therebetween). In this regard, the notches increase in size from top to bottom in the stack of weights 791-795. FIG. 19 shows the second stack of weights 791-795, and the dashed lines show the respective flanges relative to one another.

As is the case with all of the other weights 791-794, the weight 795 is similarly sized for insertion into the selector 750 (when properly oriented), and has a beveled and/or rounded lead-in surface 846 provided between the upper end of its cylindrical sidewall 845 and the upper face of the weight 795. Also, a square hole 844 extends through the weight 795 to accommodate the guide rod 717 (and preferably a bushing disposed inside the hole 804 and about the guide rod 717). The lead-in surfaces on the weights 791-795 help guide the weight selector 750 about any disengaged weights and also provide space for structurally enhanced tabs 759 on the weight selector 750, as more fully described below.

The weight selector 750 is rigidly connected to a top plate 730 that is disposed above the weights 721-727 and 791-795, and is movably mounted on the frame 710. In this regard, bushings 732 and 734 on the top plate 730 are slidably mounted on respective frame members 702 and 704, thereby defining a path of travel for the top plate 730 that is parallel to the guide rods 712, 714, and 717. An arcuate opening 737 extends through the top plate 730 to accommodate movement of the third guide rod 717 as further described below. As on other embodiments, a cable or other flexible connector 740 is interconnected between the top plate 730 and a force receiving member (not shown).

FIGS. 11-12 show the weight selector 750 apart from the rest of the machine 700. The selector 750 includes a cylindrical tube 751 having a cylindrical outside wall that is configured for insertion through central openings in respective weights 721-727 (when properly oriented), and a cylindrical opening 755 that is configured to accommodate insertion of the weights 791-795 (when properly oriented). Vertically aligned first tabs 752 project radially outward from the tube wall at axially spaced locations that align with respective weights 721-727, and vertically aligned second tabs 759 project radially inward from the tube wall at axially spaced locations that align with respective weights 791-795. FIG. 10 shows the tabs 752 in alignment with the notches in all of the weights 721-727, and the tabs 759 in alignment with the notches in all of the weights 791-795. When the weights are arranged as shown in FIG. 10, the top plate 730 and the selector 750 are movable upward relative to the frame 710 without any of the weights engaged thereby or moving therewith.

When the weights 721-727 are rotated twenty degrees clockwise (from the orientation shown in FIG. 10), the flanges associated with the uppermost weight 721 overlie the uppermost pegs 752 on the selector 750, and the top plate 730 is movable upward relative to the frame 710 together with the weight 721. Similarly, when the weights 791-795 are rotated twenty degrees clockwise (from the orientation shown in FIG. 10), the flanges associated with the uppermost weight 791 overlie the uppermost pegs 759 on the selector 750, and the top plate 730 is movable upward relative to the frame 710 together with the weight 791.

Rotation of the weights 721-727 may be accomplished by maneuvering one or both guide rods 712 and 714 in desired fashion. The top plate 730 is configured to accommodate rotation of the guide rods 712 and 714 through the range of rotation necessary to selectively engage and disengage any number of the weights 721-727. Similarly, rotation of the weights 791-795 may be accomplished by maneuvering the guide rod 717 in desired fashion. The slot 737 in the top plate 730 is configured to accommodate rotation of the guide rod 717 through the range of rotation necessary to selectively engage and disengage any number of the weights 791-795.

A first latching mechanism 772 is provided to selectively latch the upper outer section 762 of the turntable 716 in discrete orientations. The mechanism 772 includes a spring-biased plunger that is biased upward toward downwardly opening recesses in the upper outer section 762 of the turntable 616. The mechanism also includes a foot operated member or pedal that is connected to the plunger, and is accessible and configured for depression by a person's foot. A similar, second latching mechanism 779 is provided to selectively latch the upper inner section 769 of the turntable 716 in discrete orientations.

In connection with each mechanism 772 and 779 and in a manner comparable to that discussed above with reference to the previous embodiment 600, the downwardly opening recesses are circumferentially spaced at twenty degree intervals (which correspond to desired orientations of respective weights 721-727 and pegs 752 and respective weights 791-795 and pegs 759). The spring-biased plungers encourage the respective stacks of weights to lock into any desired orientation, and discourage undesired rotation of the respective stacks of weights during exercise activity. Upwardly facing indicia are preferably provided on the upper sections of the turntable 716 to show a user how to orient the stack of weights to engage a desired amount of weight. The indicia associated with the upper inner section 769 must be positioned on a strip that extends outward beyond the perimeter of the upper outer member 762 without interfering with relative rotation therebetween (via a slot or notch, for example).

On certain embodiments of the subject invention, weights are provided in two discrete stacks. An advantage of such an arrangement is that the weights in a secondary stack may facilitate fractional adjustments relative to the weights in the primary stack, thereby providing relatively more weight settings for a giving number of weights. With reference to the preceding embodiment 700, for example, the weights 721-727 in the first stack may be made relatively heavy (e.g. thirty pounds each), while the weights 791-795 in the second stack may be made relatively light (e.g. five pounds each). The provision of seven thirty-pound weights 721-727 and five independently selectable five-pound weights 791-795 provides an available resistance range of zero to 235 pounds.

The foregoing embodiments use rotation of the weights relative to one or more weight selector(s) to selectively engage and disengage the weights. An advantage of such arrangements is that the selection process can be automated or motorized with relatively few additional parts. In this regard, one or more motors can be used to perform the rotation in response to user-entered data and/or a signal from a controller. In such a scenario, information indicating a desired amount of weight or a desired change in weight may be entered via a keypad, a machine readable card, a voice recognition device, a switch on a force receiving member, or any other suitable means.

The present invention has been described with reference to specific embodiments and particular applications with the understanding that persons skilled in the art will recognize additional embodiments, applications, combinations of features, and/or improvements that nonetheless incorporate the essence of the present invention. For example, alternative forms of springs and/or dampers, including leaf springs and/or resilient pads, may be substituted for the variable length members 150. Accordingly, the scope of the present invention should be limited only to the extent of the following claims.

What is claimed is:

1. An exercise weight stack machine, comprising:

a frame configured to rest on a floor surface, wherein the frame includes at least one guide rod;

a vertical stack of weights movably mounted on the frame, wherein the stack includes a weight supporting member that is movable along a prescribed path defined by the at least one guide rod, and wherein a portion of the weight supporting member projects horizontally outward beyond an outermost edge defined by the weights disposed beneath the weight supporting member; and at least one telescoping rod and cylinder assembly connected to the frame apart from the at least one guide rod, and configured and arranged to occupy a portion of the prescribed path and impart upward force against said portion of the weight supporting member when the weight supporting member is proximate a rest position on the frame, wherein the weight supporting member is movable relative to the frame to a raised position separate and apart from the telescoping rod and cylinder assembly.

2. The exercise weight stack machine of claim 1, wherein the telescoping rod and cylinder assembly is secured to the frame adjacent the stack and external to the stack.

3. The exercise weight stack machine of claim 1, wherein the telescoping rod and cylinder assembly includes a damper.

4. The exercise weight stack machine of claim 3, wherein the telescoping rod and cylinder assembly includes a spring.

5. The exercise weight stack machine of claim 1, wherein the telescoping rod and cylinder assembly includes a spring.

6. The exercise weight stack machine of claim 1, wherein an opposite, second portion of the weight supporting member projects horizontally outward in an opposite direction beyond another outermost edge defined by the weights disposed beneath the weight supporting member, and further comprising a second said telescoping rod and cylinder assembly, wherein each said telescoping rod and cylinder assembly is configured and arranged to engage a respective said portion of the weight supporting member.

7. An exercise weight stack machine, comprising:

a frame configured to rest on a floor surface;

a vertical stack of weights movably mounted on the frame, wherein the stack includes a plurality of lower plates, and a relatively higher plate disposed above the lower plates, and a portion of the relatively higher plate projects horizontally outside a planform defined by the lower plates; and at least one transferring means mounted on the frame to project upward beyond all of the lower plates when all of the lower plates are at rest on the frame, and into a path traversed by said portion of the relatively higher plate, for transferring energy between the relatively higher plate and the frame, wherein the relatively higher plate is movable relative to the frame through a first range and a discrete second range, and the transferring means transfers energy between the relatively higher plate and the frame only when the relatively higher plate occupies the first range.

8. The exercise weight stack machine of claim 7, wherein the transferring means includes a spring and a damper.

9. The exercise weight stack machine of claim 7, wherein the relatively higher plate is movable to a position out of engagement with the transferring means.

10. An exercise weight stack machine, comprising:

a frame configured to rest on a floor surface;

a stack of weights;

a weight engaging member, wherein at least one of the weight engaging member and the stack of weights is movably mounted on the frame for movement along a prescribed path;

a weight selector selectively interconnected between the weight engaging member and a desired number of weights; and at least one compressible member mounted on the frame outside a platform defined by the weights, and extending upward beyond all of the weights when all of the weights are at rest on the frame, and into a path traversed by the weight engaging member, wherein the weight engaging member is movable relative to the frame from a first position, bearing against the at least one compressible member, to a second position, separate and apart from the at least one compressible member.

11. The exercise weight stack machine of claim 10, wherein the at least one compressible member includes a telescoping rod and cylinder assembly.

12. The exercise weight stack machine of claim 10, wherein the at least one compressible member includes left and right telescoping rod and cylinder assemblies, and the weight engaging member includes a plate having opposite left and right sides that project laterally outward beyond the planform and overlie respective said left and right telescoping rod and cylinder assemblies.

* * * * *